United States Patent [19]

Wardle et al.

[11] Patent Number: 4,648,953

[45] Date of Patent: Mar. 10, 1987

[54] ELECTROLYTIC CELL

[75] Inventors: Ian Wardle; Keith Brattan, both of Cheshire, England

[73] Assignee: Imperial Chemical Industries plc, London, England

[21] Appl. No.: 588,102

[22] Filed: Mar. 9, 1984

[30] Foreign Application Priority Data

Mar. 24, 1983 [GB] United Kingdom ..... 8308187

[51] Int. Cl.[4] ..... C25B 15/08; C25B 9/00

[52] U.S. Cl. ..... 204/237; 204/255; 204/257

[58] Field of Search ..... 204/255–256, 204/257–258, 237

[56] References Cited

U.S. PATENT DOCUMENTS

| | | | |
|---|---|---|---|
| 3,856,651 | 12/1974 | Raetzsch et al. | 204/255 |
| 4,252,628 | 2/1981 | Boulton et al. | 204/257 |
| 4,339,321 | 7/1982 | Kircher | 204/257 X |
| 4,391,693 | 7/1983 | Pimlott | 204/237 |
| 4,415,424 | 11/1983 | Pere | 204/257 |
| 4,426,270 | 1/1984 | Schmitt et al. | 240/257 |
| 4,432,858 | 2/1984 | Schmitt et al. | 204/257 |
| 4,451,346 | 5/1984 | Kircher | 204/279 X |
| 4,505,789 | 3/1985 | Ford | 204/258 X |

FOREIGN PATENT DOCUMENTS

| | | |
|---|---|---|
| 0056759 | 7/1982 | European Pat. Off. . |
| 53-124174 | 10/1978 | Japan . |

*Primary Examiner*—Donald R. Valentine

*Attorney, Agent, or Firm*—Cushman, Darby & Cushman

[57] ABSTRACT

An electrolytic cell of the filter press type comprising a plurality of anodes, cathodes and gaskets, and ion-exchange membranes positioned between each adjacent anode and cathode to form in the cell a plurality of anode compartments and cathode compartments, the cell having two inlet headers from which electrolyte may be charged to the anode compartments of the cell and from which liquors may be charged to the cathode compartments of the cell, and two outlet headers from which products of electrolysis may be removed from the anode compartments and cathode compartments of the cell, the cell being provided with a common chamber in communication with each of the anode compartments and/or a common chamber in communication with each of the cathode compartments, said chamber(s) being provided with means for recirculating liquors to the anode compartments and/or to the cathode compartments, and said chamber(s) being in communication with the outlet headers from the anode compartments and/or the outlet headers from the cathode compartments.

12 Claims, 6 Drawing Figures

ELECTROLYTIC CELL

Figure 1:
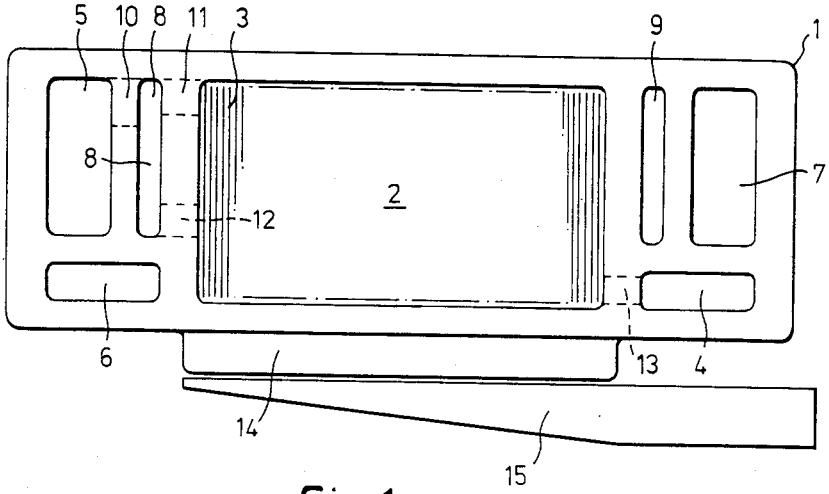

This invention relates to an electrolytic cell and in particular to an electrolytic cell of the filter press type.

Electrolytic cells are known comprising a plurality of anodes and cathodes with each anode being separated from the adjacent cathode by a separator which divides the electrolytic cell into a plurality of anode and cathode compartments. The anode compartments of such a cell are provided with means for charging electrolyte to the cell, suitably from a common header, and with means for removing products of electrolysis from the cell. Similarly, the cathode compartments of the cell are provided with means for removing products of electrolysis from the cell, and optionally with means for charging water or other fluids to the cell, suitably from a common header.

In such electrolytic cells the separator may be a substantially hydraulically impermeable ionically permselective membrane, e.g. a cation permselective membrane.

Electrolytic cells of the filter press type may comprise a large number of alternating anodes and cathodes, for example, fifty anodes alternatively with fifty cathodes, although the cell may comprise even more anodes and cathodes, for example up to one hundred and fifty alternating anodes and cathodes.

In recent years electrolytic cells of the filter press membrane type have been developed for use in the production of chorine and aqueous alkali metal hydroxide solution by the electrolysis of aqueous alkali metal chloride solution. Where aqueous alkali metal chloride solution is electrolysed in an electrolytic cell of the membrane type the solution is charged to the anode compartments of the cell and chlorine produced in the electrolysis and depleted alkali metal chloride solution are removed from the anode compartments, alkali metal ions are transported across the membranes to the cathode compartments of the cell to which water or dilute alkali metal hydroxide solution is charged, and hydrogen and alkali metal hydroxide solution produced by the reaction of alkali metal ions with hydroxyl ions are removed from the cathode compartments of the cell.

In such electrolytic cells of the filter press type the electrolyte may be charged from a common header to the individual anode compartments of the cell and the water or dilute alkali metal hydroxide solution may be charged from a common header to the individual cathode compartments of the cell, and the products of electrolysis may be removed from the individual anode and cathode compartments of the cell by feeding the products to common headers. The means for charging the electrolyte and water or dilute alkali metal hydroxide solution, and the means for removing the products of electrolysis may be separate pipes leading from separate common headers to each anode and cathode compartment of the electrolytic cell. Alternatively, the electrolytic cell may be formed from a plurality of anode plates, cathode plates and gaskets with the gaskets being positioned between adjacent anode plates and cathode plates or the anode plates and cathode plates being positioned within the gaskets, e.g. in recesses therein, and the gaskets, and optionally the anode and cathode plates, may comprise a plurality of openings therein which in the cell together form a plurality of channels lengthwise of the cell which serve as the headers. In such a cell the means of charging the electrolyte and removing the products of electrolysis may be passageways in the walls of the gaskets and/or of the anode or cathode plates which connect the headers to the anode and cathode compartments of the electrolytic cell. Electrolytic cells of this latter type are described for example in British Pat. No. 1595183 which relates to electrolytic cells of the membrane type.

In electrolytic cells, and particularly in electrolytic cells of the filter press type comprising a large number of individual anode and cathode compartments, it is very desirable that the rate of flow of electrolyte should be substantially the same to each of the anode compartments, that is that there should be an even distribution of electrolyte from the common header to the anode compartments. If there are different rates of flow of electrolyte from the header to the anode compartments the average concentration of electrolyte and the temperature of the electrolyte may vary from anode compartment to anode compartment, with consequent adverse effect on the efficiency of operation of the electrolytic cell. Similarly, it is very desirable that there should be an even distribution of liquors in the cathode compartments of the cell, and thus that there should be little or no variation in the concentration of the liquors and the temperature thereof in the cathode compartments of the cell.

The present invention relates to an electrolytic cell which is provided with means to assist in maintaining an even distribution of liquors to the anode compartments and/or to the cathode compartments of the electrolytic cell.

The present invention provides an electrolytic cell of the filter press type comprising a plurality of anodes, cathodes, and gaskets of an electrically insulating material, in which the anodes and cathodes are arranged in an alternating manner and in which an ion-exchange membrane is positioned between each adjacent anode and cathode to form in the cell a plurality of anode compartments and cathode compartments, the cell having two inlet headers from which, respectively, electrolyte may be charged to the anode compartments of the cell and from which liquors may be charged to the cathode compartments of the cell, and two outlet headers from which, respectively, products of electrolysis may be removed from the anode compartments and cathode compartments of the cell, characterised in that the cell is provided with a common chamber in communication with each of the anode compartments and/or a common chamber in communication with each of the cathode compartments, said chamber(s) being provided with means for recirculating liquors to the anode compartments and/or to the cathode compartments, and said chamber(s) being in communication with the outlet headers from the anode compartments and/or the outlet header from the cathode compartments.

The anodes and cathodes will generally be in the form of plates in an electrolytic cell of the filter press type, and the invention will be described by reference to anode plates and cathode plates.

In the electrolytic cell the anode compartments are in communication with an inlet header and with an outlet header, which may be lengthwise of the cell. In a preferred embodiment of the electrolytic cell each of these headers is formed by openings in the gaskets and optionally in the anode plates and cathode plates, the openings together forming the headers. The means of communication may be passageways in the walls of the gaskets and/or in the walls of the anode plates.

Similarly, in the electrolytic cell the cathode compartments are in communication with an inlet header and an outlet header, which may be lengthwise of the cell.

In a preferred embodiment of the electrolytic cell each of these headers is formed by openings in the gaskets and optionally in the anode plates and cathode plates. The means of communication may be passageways in the walls of the gaskets and/or in the walls of the cathode plates.

In the known electrolytic cell of the type hereinbefore described the liquors from the anode compartments and from the cathode compartments flow into the respective outlet headers in communication with these compartments. In these headers separation of gaseous and liquid products of electrolysis takes place. For example, in the electrolysis of aqueous sodium chloride solution separation of gaseous chlorine from depleted aqueous sodium chloride solution takes place in the header in communication with the anode compartments, and separation of hydrogen from sodium hydroxide solution takes place in the header in communication with the cathode compartments.

The liquors in these outlet headers do not provide a constant pressure head of liquor in communication with the anode and cathode compartments of the cell as the liquors in the outlet headers are of variable density, due to the presence of gaseous products of electrolysis, and of variable height. Indeed, the level of liquors in the outlet headers may be below that of the liquors in the anode compartments and/or in the cathode compartments. It is a function of the common chamber in communication with each of the anode compartments and with the outlet header therefrom, and of the common chamber in communication with each of the cathode compartments and with the outlet header therefrom, to provide such a constant pressure head on the liquors in the anode compartments and/or in the cathode compartments. In order to provide this pressure head the common chamber(s) must be provided with means for recirculating liquors to the anode compartments and/or to the cathode compartments, although in use there may in fact be little if any such recirculation of liquors. For example communication between a common chamber and the anode compartments and/or between a common chamber and the cathode compartments may be provided by pairs of communicating passageways between a common chamber and each of the anode compartments and/or pairs of communicating passageways between a common chamber and each of the cathode compartments. The communicating passageways may be in the form of an upper and lower passageways. The passageways may be formed in the walls of the gaskets and/or in the walls of the anode and/or cathode plates. The communicating passageways provide pathways by which liquid may pass between the anode compartment and a common chamber and between the cathode compartment and a separate common chamber, thus providing a pressure head which acts upon the liquors in the anode compartments and a pressure head which acts on the liquors in the cathode compartments.

Where the anodes and cathodes are positioned within gaskets, e.g. in recesses in the gaskets, the common chambers in communication with the anode compartments and with the outlet header from the anode compartments may be provided by openings in the gaskets which together form the common chamber. Similarly, the common chamber in communication with the cathode compartments and with the outlet header from the cathode compartments may be provided by openings in the gaskets which together form the common chamber.

Where gaskets are positioned between adjacent anodes and cathodes so as to electrically insulate the anode from an adjacent cathode the anodes and cathodes may also have openings therein which form a part of the common chambers.

In an alternative embodiment the common chamber in communication With the anode compartments and with the outlet header from the anode compartments may be provided by an open trough positioned in the header. Similarly, the common chamber in communication with the cathode compartments and with the outlet header from the cathode compartments may be provided by an open trough positioned in the header.

In use the open troughs fill with liquid and provide constant liquid pressure heads to the anode compartments and to the cathode compartments.

Figure 2:
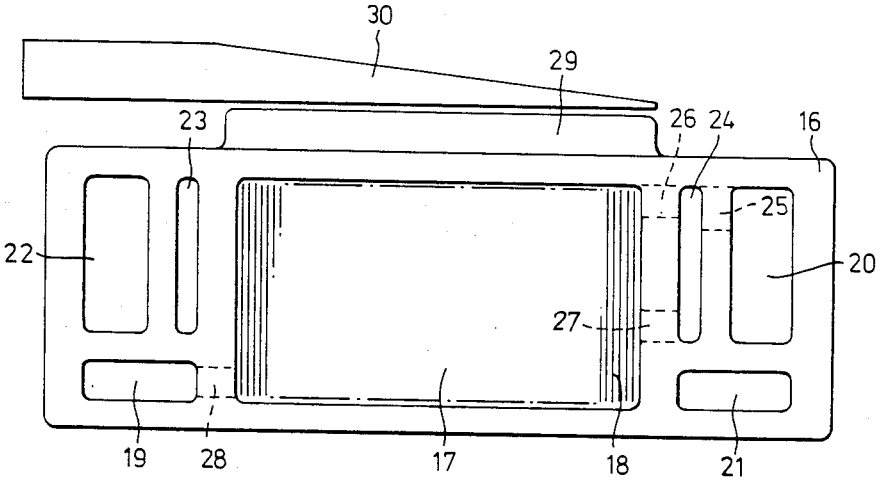
Figure 3:
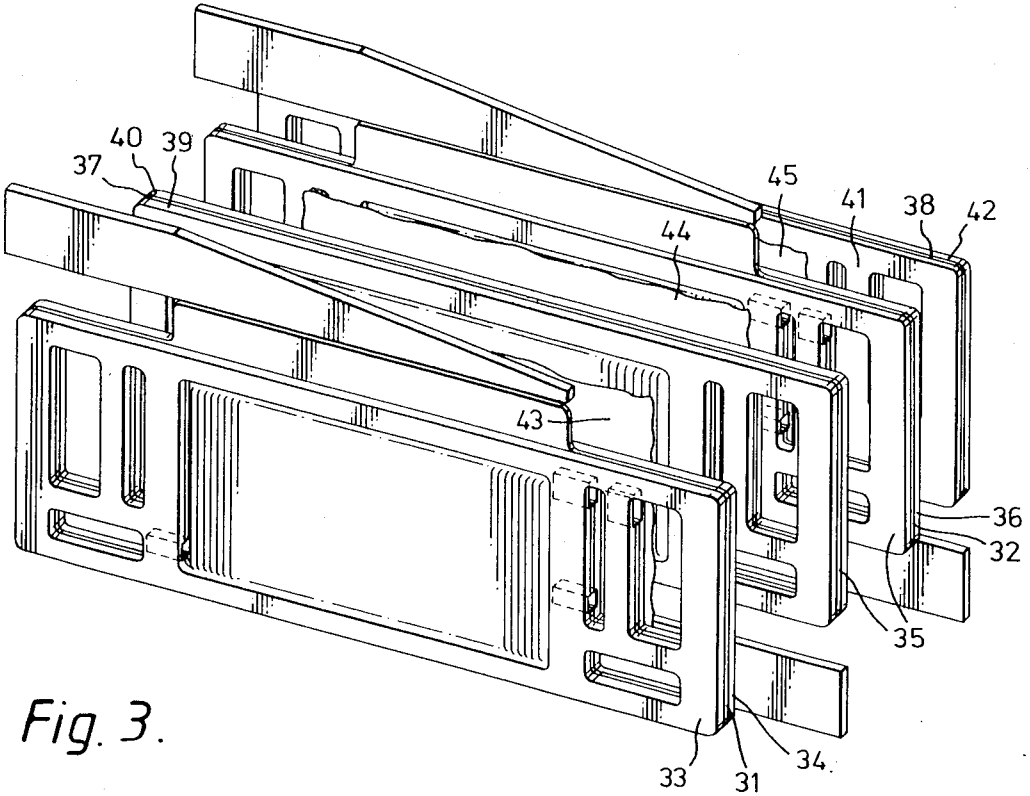
Figure 4:
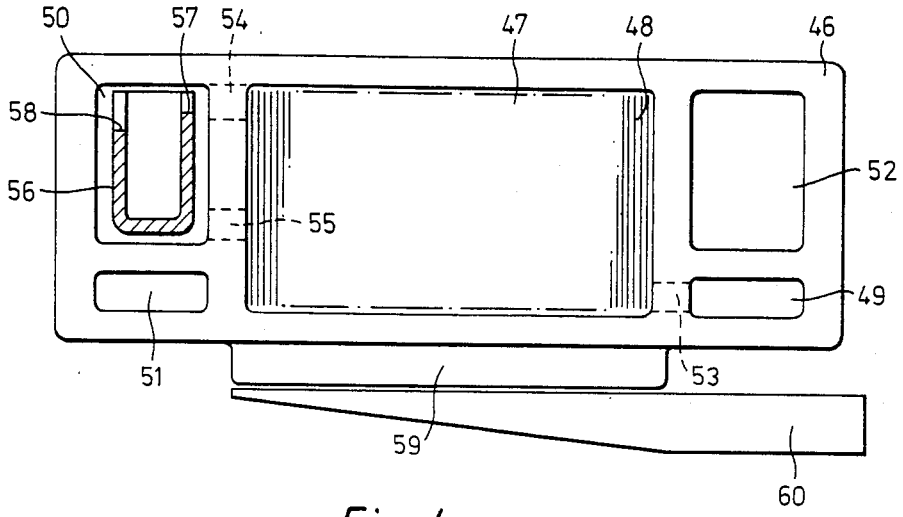
Figure 5:
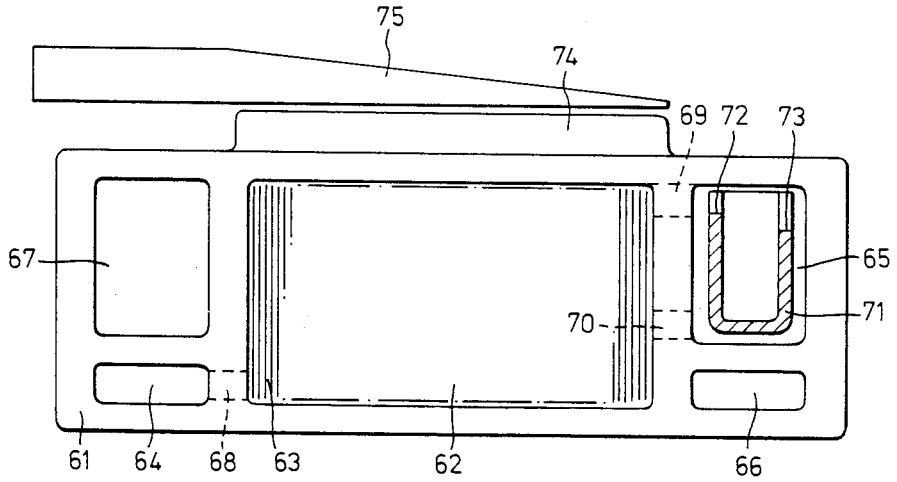
Figure 6:
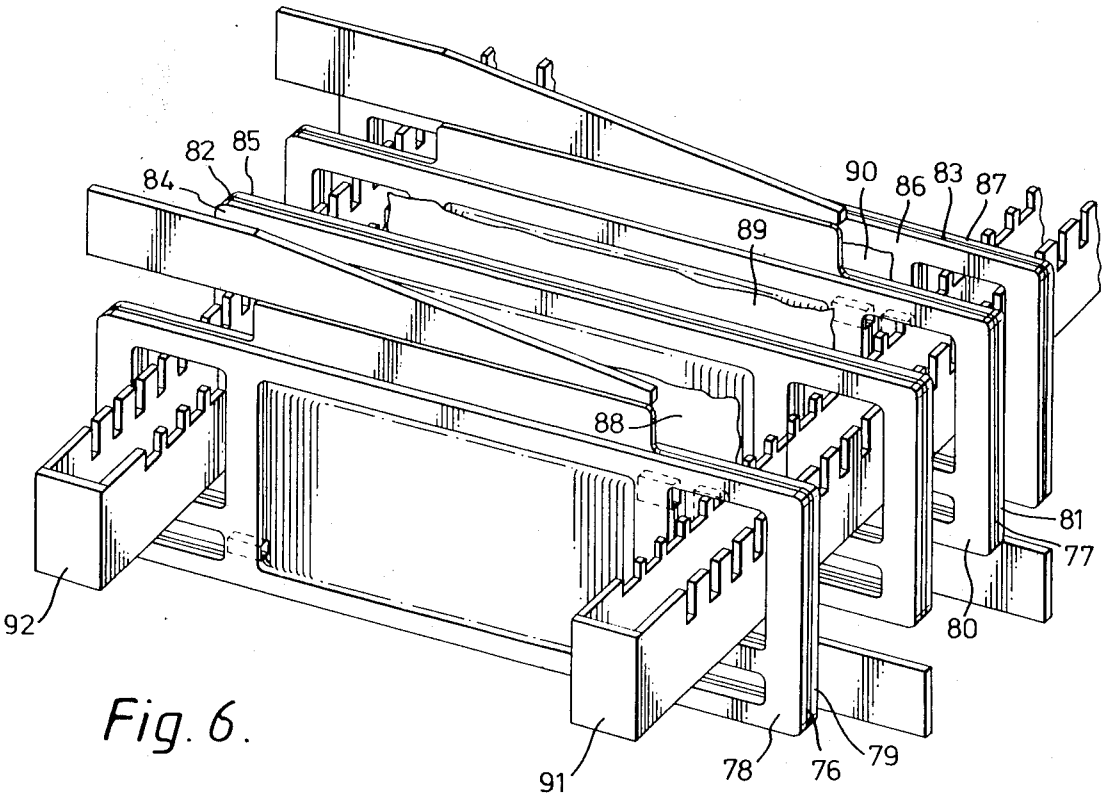

Preferred embodiments of the electrolytic cell of the invention will be described with the aid of the following drawings in which FIG. 1 is a view in elevation of an anode, FIG. 2 is a view in elevation of a cathode, FIG. 3 is an exploded isometric view of a part of an electrolytic cell incorporating the anodes and cathodes of FIGS. 1 and 2, FIG. 4 is a view in elevation of an alternative form of an anode, FIG. 5 is a view in elevation of an alternative form of a cathode, and FIG. 6 is an exploded isometric view of a part of an electrolytic cell incorporating the anodes and cathodes of FIGS. 4 and 5.

Referring to FIG. 1 the anode comprises a plate (1) having a central opening (2) which is bridged by a plurality of vertically disposed strips (3) which form the active anode surface. These strips (3) are displaced from and lie in a plane parallel to that of the plate (1). A group of strips is positioned on both sides of the plate (1). The plate (1) comprises four openings (4, 5, 6, 7) which in the cell form a part of separate lengthwise headers for, respectively, electrolyte to be charged to the anode compartments, products of electrolysis to be removed from the anode compartments, liquor to be charged to the cathode compartments, and products of electrolysis to be removed from the cathode compartments. The anode plate (1) also comprises two further openings (8, 9) which in the electrolytic cell form a part of the common chambers in communication with, respectively, the anode compartments and cathode compartments, and with outlet headers therefrom. The opening (8) is in communication via passageway (10) in the wall of the anode plate (1) with the opening (5), and it is in communication via passageways (11, 12) in the wall of the anode plate (1) with the central opening (2) which in the electrolytic cell forms a part of the anode compartment. The anode plate (1) is also provided with a passageway (13) connecting the opening (4) with the central opening (2), and with a projection (14) which is connected to a lead (15) for connection to a bus-bar.

Referring to FIG. 2 the cathode comprises a plate (16) having a central opening (17) which is bridged by a plurality of vertically disposed strips (18) which form the active cathode surface. These strips (18) are displaced from and lie in a plane parallel to that of the plate (16). A group of strips is positioned on both sides of the plate (16). The plate (16) comprises four openings (19,

20, 21, 22) which in the cell form a part of separate lengthwise headers for, respectively, liquors to be charged to the cathode compartments, products of electrolysis to be removed from the cathode compartments, electrolyte to be charged to the anode compartments, and products of electrolysis to be removed from the anode compartments. The cathode plate (16) also comprises two further openings (23, 24) which in the electrolytic cell form a part of the common chambers in communication with, respectively, the anode compartments and cathode compartments, and with outlet headers therefrom. The opening (24) is in communication via passageway (25) in the wall of the cathode plate (16) with the opening (20), and it is in communication via passageways (26, 27) in the wall of the plate (16) with the central opening (17) which in the electrolytic cell forms a part of the cathode compartment. The cathode plate (16) is also provided with a passageway (28) connecting the opening (19) with the central opening (17), and with a projection (29) which is connected to a lead (30) for connection to a bus-bar.

Referring to FIG. 3, there is shown a part of an electrolytic cell comprising two cathodes (31, 32) each of which has a pair of gaskets of an elastomeric material (33, 34 and 35, 36) positioned on either side thereof. The part of the cell shown also comprises two anodes (37, 38) each of which has a pair of gaskets of an elastomeric material (39, 40 and 41, 42) positioned on either side thereof. Also shown are three ion-exchange membranes (43, 44, 45), a membrane being positioned between each adjacent anode and cathode. The boundaries of an anode compartment are formed by membranes (43) and (44), and the boundaries of a cathode compartment are formed by membranes (44) and (45). The electrolytic cell is also provided with end plates (not shown) and with means (not shown) for charging liquors to the headers and for removing products of electrolysis from the headers.

Operation of the electrolytic cell will be described with reference to the anodes and cathodes illustrated respectively in FIGS. 1 and 2.

Referring to FIG. 1, electrolyte, e.g. aqueous alklai metal chloride solution, is charged to the header of which opening (4) in anode plate (1) forms a part, and the electrolyte passes through passage-way (13) into the anode compartment of the cell of which opening (2) in anode plate (1) forms a part. Gaseous and liquid products of electrolysis flow out of the anode compartment via passageway (11) and the liquid product fills up the chamber of which opening (8) forms a part, and the gaseous product of electrolysis passes via passageway (10) into the header of which opening (5) forms a part, and thence out of the cell. The liquid product of electrolysis also flows via passageway (10) into the header of which opening (5) forms a part, and thence out of the cell. The liquid product in the chamber of which opening (8) forms a part ensures that a constant head of liquid is maintained via passageways (12) in all of the anode plates which are in communication with the anode compartments of the cell. Liquid product of electrolysis also circulates between the anode compartment and the chamber of which opening (8) forms a part via passageways (11) and (12).

Referring to FIG. 2, liquid, e.g. water or dilute alkali metal hydroxide solution, is charged to the header of which opening (19) in cathode plate (16) forms a part, and the liquid passes through passageway (28) into the cathode compartment of the cell of which opening (17) in cathode plate (16) forms a part. Gaseous and liquid products of electrolysis flow out of the cathode compartment via passageway (26) and the liquid product fills up the chamber of which opening (24) forms a part, and the gaseous product of electrolysis passes via passageway (25) into the header of which opening (20) forms a part, and thence out of the cell. The liquid product of electrolysis flows via passageway (25) into the header of which opening (20) forms a part, and thence out of the cell. The liquid product in the chamber of which opening (24) forms a part ensures that a constant head of liquid is maintained via passageways (27) in all of the cathode plates which are in communication with the cathode compartments of the cell. Liquid product of electrolysis also circulates between the cathode compartment and the chamber of which opening (24) forms a part via passageways (26) and (27).

The embodiment illustrated in FIGS. 4, 5 and 6 will now be described.

Referring to FIG. 4 the anode comprises a plate (46) having a central opening (47) which is bridged by a plurality of vertically disposed strips (48) which form the active anode surface. These strips (48) are displaced from and lie in a plane parallel to that of the plate (46). A group of strips is positioned on both sides of the plate (46). The plate (46) comprises four openings (49, 50, 51, 52) which in the cell form a part of separate lengthwise headers for, respectively, electrolyte to be charged to the anode compartments, products of electrolysis to be removed from the anode compartments, liquor to be charged to the cathode compartments, and products of electrolysis to be removed from the cathode compartments. The plate (46) also comprises a passageway (53) in the wall thereof between the opening (49) and the central opening (47), and passageways (54, 55) between the central opening (47) and the opening (50). In the opening (50), which forms a part of the header through which products of electrolysis are removed from the anode compartments, there is positioned an open trough (56) which is positioned lengthwise of the whole of the cell, the trough having a lip (57) and a lip (58). The anode (46) is also provided with a projection (59) connected to a lead (60) for connection to a busbar.

Referring to FIG. 5 the cathode comprises a plate (61) having a central opening (62) which is bridged by a plurality of vertically disposed strips (63) which form the active cathode surface. These strips (63) are displaced from and lie in a plane parallel to that of the plate (61). A group of strips is positioned on both sides of the plate (61). The plate (61) comprises four openings (64, 65, 66, 67) which in the cell form a part of separate lengthwise headers for, respectively, liquors to be charged to the cathode compartments, products of electrolysis to be removed from the cathode compartments, electrolyte to be charged to the anode compartments, and products of electrolysis to be removed from the anode compartments. The plate (61) also comprises a passageway (68) in the wall thereof between the opening (64) and the central opening (62), and passageways (69, 70) between the central opening (62) and the opening (65). In the opening (65), which forms a part of the header through which products are removed from the cathode compartments, there is positioned an open trough (71) which is positioned lengthwise of the whole of the cell, the trough having a lip (72) and a lip (73). The cathode (61) is also provided with a projection (74) connected to a lead (75) for connection to a bus-bar.

Referring to FIG. 6, there is shown a part of an electrolytic cell comprising two cathodes (76, 77) each of which has a pair of gaskets of an elastomeric material (78, 79 and 80, 81) positioned on either side thereof. The part of the cell shown also comprises two anodes (82, 83) each of which has a pair of gaskets of an elastomeric material (84, 85 and 86, 87) positioned on either side thereof. Also shown are three ionexchange membranes (88, 89, 90), a membrane being positioned between each adjacent anode and cathode. The boundaries of an anode compartment are formed by membranes (88) and (89), and the boundaries of a cathode compartment are formed by membranes (89) and (90). The electrolytic cell is also provided with end plates (not shown) and with means (not shown) for charging liquors to the headers and for removing products of electrolysis from the headers.

Also shown in the embodiment of FIG. 6 are two troughs (91, 92) positoned lengthwise of the cell.

Operation of the electrolytic cell will be described with reference to the anodes and cathodes illustrated respectively in FIGS. 4 and 5.

Referring to FIG. 4, electrolyte, e.g. aqueous alkali metal chloride solution, is charged to the header of which opening (49) in anode plate (46) forms a part, and the electrolyte passes through passage-way (53) into the anode compartment of the cell of which opening (47) in anode plate (46) forms a part. Gaseous and liquid products of electrolysis flow out of the anode compartment via passageway (54) and the liquid product fills the space between the trough (56) and the wall of the opening (50). Gaseous product of electrolysis separates and eventually passes out of the cell. The liquid product of electrolysis spills over the lip (58) into the trough (56) and hence out of the cell. The liquid may circulate back to the anode compartment of which opening (47) in anode plate (46) forms a part via passageway (55). The liquid in the trough (56) in the header of which opening (50) forms a part ensures that a constant head of liquid is maintained to all the anode compartments of the cell via passageways (55) in all of the anode plates.

Referring to FIG. 5, liquid, e.g. water or alkali metal hydroxide solution, is charged to the header of which opening (64) in cathode plate (61) forms a part and the liquid passes through the passageway (68) into the cathode compartment of the cell of which opening (62) in cathode plate (61) forms a part. Gaseous and liquid products of electrolysis flow out of the cathode compartment via passageway (69) and the liquid product fills the space between the trough (71) and the wall of the opening (65). Gaseous product of electrolysis separates and eventually passes out of the cell. The liquid product of electrolysis spills over the lip (73) into the trough (71) and hence out of the cell. The liquid may circulate back to the cathode compartment of which opening (62) in cathode plate (61) forms a part via passageway (70). The liquid in the trough (71) in the header of which opening (65) forms a part ensures that a constant head of liquid is maintained to all the cathode compartments of the cell via passageways (70) in all the cathode plates.

Hydraulically impermeable ion-exchange membranes are known in the art and are preferably fluorine-containing polymeric materials containing anionic groups. The polymeric materials preferably are fluorocarbons containing the repeating groups $$[C_mF_{2m}]_M \text{ and } [CF_2-\underset{\underset{X}{|}}{CF}]_N$$

where m has a value of 2 to 10, and is preferably 2, the ratio of M to N is preferably such as to give an equivalent weight of the groups X in the range 500 to 2000, and X is chosen from $$[OCF_2-\underset{\underset{Z}{|}}{CF}]_p A$$

where p has the value of for example 1 to 3, Z is fluorine or a perfluoroalkyl group having from 1 to 10 carbon atoms, and A is a group chosen from the groups:

$-SO_3H$
$-CF_2SO_3H$
$-CCl_2SO_3H$
$-X^1SO_3H$
$-PO_3H_2$
$-PO_2H_2$
$-COOH$ and
$-X^1OH$ or derivatives of the said groups, where $X^1$ is an aryl group. Preferably A represents the group $SO_3H$ or $-COOH$. $SO_3H$ group-containing ion exchange membranes are sold under the tradename 'Nafion' by E I DuPont de Nemours and Co Inc and $-COOH$ group-containing ion exchange membranes under the tradename 'Flemion' by the Asahi Glass Co Ltd.

The electrolytic cell comprises a plurality of gaskets of electrically insulating material which electrically insulate each anode from the adjacent cathodes. The gasket is desirably flexible and preferably resilient and it should be resistant to the electrolyte and to the products of electrolysis. The gasket may be made of an organic polymer, for example a polyofefin, e.g. polyethylene or polypropylene; a hydrocarbon elastomer, e.g. an elastomer based on ethylene-propylene copolymers or ethylene-propylenediene copolymers, natural rubber, or styrene-butadiene rubber; or a chlorinated hydrocarbon, e.g. polyvinyl chloride or polyvinylidene chloride. In an electrolytic cell for the electrolysis of aqueous alkali metal chloride solution the material of the gasket may be a fluorinated polymeric material, for example polytetrafluoroethylene, polyvinyl fluoride, polyvinylidene fluoride, or a tetrafluoroethylene-hexafluoropropylene copolymer, or a substrate having an outer layer of such a fluorinated polymeric material.

In the electrolytic cell the gasket may comprise a central opening defined by a frame-like section, which in the cell defines a part of the anode compartment or cathode compartment and openings in the frame-like section which in the cell form a part of the lengthwise channels which form the headers.

The anode may be metallic and the nature of the metal will depend on the nature of the electrolyte to be electrolysed in the electrolytic cell. A preferred metal is a film-forming metal, particularly where an aqueous solution of an alkali metal chloride is to be electrolysed in the cell.

The film-forming metal may be one of the metals titanium, zirconium, niobium, tantalum or tungsten or an alloy consisting principally of one or more of these metals and having anodic polarisation properties which are comparable with those of the pure metal. It is preferred to use titanium alone, or an alloy based on titanium and having polarisation properties comparable with those of titanium.

The anode will have a central anode portion and, where it comprises openings which in the cell form a part of the lengthwise channels which form the headers these openings will be in a position corresponding to the positions of the openings in the gaskets. Alternatively, such openings may not be present in the anode and the anode may be positioned within a gasket, e.g. in a recess in a gasket.

The anode portion may comprise a plurality of elongated members, which are preferably vertically disposed, for example in the form of louvres or strips, or it may comprise a foraminate surface such as mesh, expanded metal or a perforated surface. The anode portion may comprise a pair of foraminate surfaces disposed substantially parallel to each other.

The anode portion of the anode may carry a coating of an electroconducting electrocatalytically active material. Particularly in the case where an aqueous solution of an alkali metal chloride is to be electrolysed this coating may for example consist of one or more platinum group metals, that is platinum, rhodium, iridium, ruthenium, osmium and palladium, or alloys of the said metals, and/or an oxide or oxides thereof. The coating may consist of one or more of the platinum group metals and/or oxides thereof in admixture with one or more non-noble metal oxides, particularly a film-forming metal oxide. Especially suitable electrocatalytically active coatings include platinum itself and those based on ruthenium dioxide/titanium dioxide, ruthenium dioxide/tin dioxide, and ruthenium dioxide/tin dioxide/-titanium dioxide.

Such coatings, and methods of application thereof, are well known in the art.

The cathode may be metallic and the nature of the metal will also depend on the nature of the electrolyte to be electrolysed in the electrolytic cell. Where an aqueous solution of an alkali metal chloride is to be electrolysed the cathode may be made, for example of, steel, copper, nickel or copper—or nickel-coated steel.

The cathode will have a central cathode portion and, where it comprises openings which in the cell form a part of the lengthwise channels which form the headers these openings will be in a position corresponding to the positions of the openings in the gaskets. Alternatively, such openings may not be present in the cathode and the cathode may be positioned with a gasket, e.g. in a recess in a gasket.

The cathode portion may comprise a plurality of elongated members, which are preferably vertically disposed, for example in the form of louvres or strips, or it may comprise a foraminate surface such as mesh, expanded metal or perforated surface. The cathode portion may comprise a pair of foraminate surfaces disposed substantially parallel to each other.

The cathode portion of the cathode plate may carry a coating of a material which reduces the hydrogen overvoltage at the cathode when the electrolytic cell is used in the electrolysis of aqueous alkali metal choride solution. Such coatings are known in the art.

The anodes and cathodes are provided with means for attachment to a power source. For example, they may be provided with extensions which are suitable for attachment to appropriate bus-bars.

It is desirable that both the anodes and cathodes are flexible, and preferably that they are resilient, as flexibility and resiliency assists in the production of leak-tight seals when they are assembled into an electrolytic cell.

The thickness of the anodes and cathodes, is suitably in the range 0.5 mm to 3 mm.

The electrolytic cell may be a monopolar or a bipolar cell. In a monopolar cell an ion-exchange membrane is positioned between each adjacent anode and cathode. In a bipolar cell an ion-exchange membrane is positioned between an anode of a bipolar electrode and a cathode of an adjacent bipolar electrode. In the case of a monopolar cell it is preferred that the dimensions of the anodes and cathodes in the direction of current flow are such as to provide short current paths which in turn ensure low voltage drops in the anodes and cathodes without the use of elaborate current carrying devices. A preferred dimension in the direction of current flow is in the range 15 to 60 cm.

Where the anodes and cathodes comprise openings which in the electrolytic cell form a part of the headers it is necessary to ensure that the headers which are in communication with the anode compartments of the cell are insulated electrically from the headers which are in communication with the cathode compartments of the cell. This electrical insulation may be achieved by means of frame-like members of electrically insulating material inserted in the openings in the anodes and cathodes which form a part of the headers.

We claim:

1. An electrolytic cell of the filter press type comprising a plurality of anodes, cathodes and gaskets of an electrically insulating material, in which the anodes and cathodes are arranged in an alternating manner and in which an ion-exchange membrane is positioned between each adjacent anode and cathode to form in the cell a plurality of anode compartments and cathode compartments, the cell having two inlet headers from which, respectively, electrolyte may be charged to the anode compartments of the cell and from which liquors may be charged to the cathode compartments of the cell, and two outlet headers from which, respectively, products of electrolysis may be removed from the anode compartments and cathode compartments of the cell, characterised in that the gaskets comprise four openings which together form the headers or a part thereof, and the cell is provided with a common chamber in communication with each of the anode compartments and/or a common chamber in communication with each of the cathode compartments, said chamber(s) being provided with means for recirculating liquors to the anode compartments and/or to the cathode compartments, and said chamber(s) being in communication with the outlet headers from the anode compartment and/or the outlet headers from the cathode compartments.

2. An electrolytic cell as claimed in claim 1, characterised in that the anodes and cathodes are in the form of plates.

3. An electrolytic cell as claimed in claim 1 or claim 2, characterised in that the inlet headers and outlet headers are arranged lengthwise of the electrolytic cell.

4. An electrolytic cell as claimed in claim 1, characterised in that the anodes and cathodes comprise four openings which together form a part of the headers.

5. An electrolytic cell of the filter press type comprising a plurality of anodes, cathodes and gaskets of an electrically insulating material, in which the anodes and cathodes are arranged in an alternating manner and in which an ion-exchange membrane is positioned between each adjacent anode and cathode to form in the cell a plurality of anode compartments and cathode compartments, the cell having two inlet headers from which, respectively, electrolyte may be charged to the anode compartments of the cell and from which liquors may be charged to the cathode compartments of the cell, and two outlet headers from which, respectively, products of electrolysis may be removed from the anode compartments and cathode compartments of the cell, characterised in that the cell is provided with a common chamber in communication with each of the anode compartments and/or a common chamber in communication with each of the cathode compartments, said chamber(s) being provided with means for recirculating liquors to the anode compartments and/or to the cathode compartments, and said chamber(s) being in communication with the outlet headers from the anode compartments and/or the outlet headers from the cathode compartments and further characterised in that communication between a common chamber and each of the anode compartments is provided by pairs of passageways between a common chamber and each of the anode compartments.

6. An electrolytic cell as claimed in claim 5, characterised in that the passageways are in the form of upper and lower passageways.

7. An electrolytic cell as claimed in claim 5, characterised in that the common chamber in communication with the anode compartments and with the outlet header from the anode compartments is provided by openings in the anodes and cathodes and gaskets which together form the common chamber.

8. An electrolytic cell as claimed in claim 5, characterised in that the common chamber in communication with the cathode compartments and with the outlet header from the cathode compartments is provided by openings in the anodes and cathodes and gaskets which together form the common chamber.

9. An electrolytic cell of the filter press type comprising a plurality of anodes, cathodes and gaskets of an electrically insulating material, in which the anodes and cathodes are arranged in an alternating manner and in which an ion-exchange membrane is positioned between each adjacent anode and cathode to form in the cell a plurality of anode compartments and cathode compartments, the cell having two inlet headers from which, respectively, electrolyte may be charged to the anode compartments of the cell and from which liquors may be charged to the cathode compartments of the cell, and two outlet headers from which, respectively, products of electrolysis may be removed from the anode compartments and cathode compartments of the cell, characterised in that the cell is provided with a common chamber in communication with each of the anode compartments and/or a common chamber in communication with each of the cathode compartments, said chamber(s) being provided with means for recirculating liquors to the anode compartments and/or to the cathode compartments, and said chamber(s) being in communication with the outlet headers from the anode compartments and/or the outlet headers from the cathode compartments and further characterised in that communication between a common chamber and each of the cathode compartments is provided by pairs of passageways between a common chamber and each of the cathode compartments.

10. An electrolytic cell as claimed in claim 9, characterised in that the passageways are formed in the walls of the anode plates and/or in the walls of the cathode plates.

11. An electrolytic cell of the filter press type comprising a plurality of anodes, cathodes and gaskets of an electrically insulating material, in which the anodes and cathodes are arranged in an alternating manner and in which an ion-exchange membrane is positioned between each adjacent anode and cathode to form in the cell a plurality of anode compartments and cathode compartments, the cell having two inlet headers from which, respectively, electrolyte may be charged to the anode compartments of the cell and from which liquors may be charged to the cathode compartments of the cell, and two outlet headers from which, respectively, products of electrolysis may be removed from the anode compartments and cathode compartments of the cell, characterised in that the cell is provided with a common chamber in communication with each of the anode compartments and/or a common chamber in communication with each of the cathode compartments, said chamber(s) being provided with means for recirculating liquors to the anode compartments and/or to the cathode compartments, and said chamber(s) being in communication with the outlet headers from the anode compartments and/or the outlet headers from the cathode compartments and further characterised in that the common chamber in communication with the anode compartments and with the outlet header from the anode compartments is provided by an open trough positioned in said header.

12. An electrolytic cell of the filter press type comprising a plurality of anodes, cathodes and gaskets of an electrically insulating material, in which the anodes and cathodes are arranged in an alternating manner and in which an ion-exchange membrane is positioned between each adjacent anode and cathode to form in the cell of a plurality of anode compartments and cathode compartments, the cell having two inlet headers from which, respectively, electrolyte may be charged to the anode compartments of the cell and from which liquors may be charged to the cathode compartments of the cell, and two outlet headers from which, respectively, products of electrolysis may be removed from the anode compartments and cathode compartments of the cell, characterised in that the cell is provided with a common chamber in communication with each of the anode compartments and/or a common chamber in communication with each of the cathode compartments, said chamber(s) being provided with means for recirculating liquors to the anode compartments and/or to the cathode compartments, and said chamber(s) being in communication with the outlet headers from the anode compartments and/or the outlet headers from the cathode compartments and further characterised in that the common chamber in communication with the cathode compartments and with the outlet header from the cathode compartments is provided by an open trough positioned in said header.

* * * * *